US008109398B2

(12) United States Patent
Lewis et al.

(10) Patent No.: US 8,109,398 B2
(45) Date of Patent: Feb. 7, 2012

(54) MULTI-PANEL PLASTIC CONTAINER WITH ASYMMETRIC VACUUM PANELS

(75) Inventors: Benton A. Lewis, Manchester, PA (US); Luis Carvallo, York, PA (US); Justin A. Howell, New Cumberland, PA (US)

(73) Assignee: Graham Packaging Company, L.P., York, PA (US)

( * ) Notice: Subject to any disclaimer, the term of this patent is extended or adjusted under 35 U.S.C. 154(b) by 309 days.

(21) Appl. No.: 12/476,350

(22) Filed: Jun. 2, 2009

(65) Prior Publication Data

US 2010/0301003 A1 Dec. 2, 2010

(51) Int. Cl.
*B65D 23/10* (2006.01)
*B65D 1/42* (2006.01)

(52) U.S. Cl. ..... 215/384; 215/381; 220/675; 220/771

(58) Field of Classification Search ..... 215/379, 215/381–384, 396, 398, 380, 900; 220/771, 220/666, 669, 671, 675
See application file for complete search history.

(56) References Cited

U.S. PATENT DOCUMENTS

| | | | | |
|---|---|---|---|---|
| 5,971,184 | A * | 10/1999 | Krishnakumar et al. | 215/384 |
| 6,494,333 | B2 * | 12/2002 | Sasaki et al. | 215/384 |
| 6,837,390 | B2 * | 1/2005 | Lane et al. | 215/381 |
| 6,935,525 | B2 | 8/2005 | Trude | |
| 7,014,056 | B2 | 3/2006 | Trude | |
| 7,073,675 | B2 | 7/2006 | Trude | |
| 7,118,002 | B2 * | 10/2006 | Saito et al. | 215/384 |
| D542,666 | S | 5/2007 | Trude | |
| 7,458,478 | B2 * | 12/2008 | Kamineni | 215/381 |
| 2001/0035392 | A1 * | 11/2001 | Ota et al. | 215/381 |
| 2003/0205550 | A1 * | 11/2003 | Prevot et al. | 215/384 |
| 2005/0139572 | A1 * | 6/2005 | Pedmo et al. | 215/381 |
| 2005/0218107 | A1 * | 10/2005 | Sabold et al. | 215/382 |
| 2006/0076310 | A1 * | 4/2006 | Mooney et al. | 215/382 |
| 2006/0157439 | A1 | 7/2006 | Howell | |
| 2006/0180568 | A1 * | 8/2006 | Lane | 215/384 |
| 2007/0075032 | A1 | 4/2007 | Kelley et al. | |
| 2007/0090083 | A1 | 4/2007 | Trude | |
| 2007/0125743 | A1 | 6/2007 | Pritchett et al. | |
| 2007/0187355 | A1 * | 8/2007 | Kamineni | 215/384 |
| 2007/0210028 | A1 * | 9/2007 | Heisner et al. | 215/384 |
| 2007/0257004 | A1 | 11/2007 | Howell et al. | |

FOREIGN PATENT DOCUMENTS

WO 2006039523 A1 4/2006

* cited by examiner

*Primary Examiner* — Sue Weaver
(74) *Attorney, Agent, or Firm* — Knoble Yoshida & Dunleavy, LLC

(57) ABSTRACT

A plastic container that particularly adapted for hot-fill applications includes a bottom portion; and a sidewall portion that is unitary with the bottom portion. The sidewall portion has a maximum outer diameter, and includes first and second pairs of opposing first and second vacuum panels, respectively. At least one of the second vacuum panels includes gripping structure. The first and second vacuum panels respectively have first and second substantially constant radii of curvature as measured in a horizontal plane that are substantially constant from upper to lower ends of the vacuum panels. At least one of the second vacuum panels may be asymmetric about a central vertical axis as viewed in side elevation.

24 Claims, 5 Drawing Sheets

MULTI-PANEL PLASTIC CONTAINER WITH ASYMMETRIC VACUUM PANELS

BACKGROUND OF THE INVENTION

1. Field of the Invention

This invention relates generally to the field of plastic containers, and more particularly to plastic containers that are designed to accommodate the volumetric expansion and contraction that is inherent to the hot-fill packaging process.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

Hot fill containers are designed to be used with the conventional hot fill process in which a liquid product such as fruit juice is introduced into the container while warm or hot, as appropriate, for sanitary packaging of the product. After filling, such containers undergo significant volumetric shrinkage as a result of the cooling of the product within the sealed container. Hot fill type containers accordingly must be designed to have the capability of accommodating such shrinkage. Typically this has been done by incorporating one or more vacuum panels into the side wall of the container that are designed to flex inwardly as the volume of the product within the container decreases as a result of cooling.

Typically, the vacuum panel regions of conventional hot fill containers are characterized by having surfaces that are designed to deflect inwardly when the product within the sealed container undergoes shrinkage. In some instances, an island may be defined in the middle of the vacuum panel in order to provide support for an adhesive label that may be placed over the container. In other instances, ribs may be molded into the vacuum panel area in order to provide an enhanced grip surface or to enhance the strength of the vacuum panel area. Grippability for the consumer is an important consideration in the design of many containers. In containers that have vacuum panels with gripping structure, the technology for optimizing the efficacy of the gripping structure and the dimensional stability of the container while it is being gripped while at the same time permitting sufficient flexibility to accommodate volumetric changes within the container is still evolving. Minor changes in curvature and geometry may be important to such optimization. Top load strength and efficient utilization of plastic material are also important design considerations for such containers.

Vacuum panels of conventional hot-fill containers, including those vacuum panels that are provided with structure to enhance gripping, typically are designed to be substantially symmetrical about a central vertical axis as viewed in side elevation. PCT Publication WO 2007/041422 discloses such a container having four vacuum panels. In hot-fill container designs that have an even number of vacuum panels, opposing panels are also typically shaped to be substantially symmetrical about the center axis of the container.

A need has existed for an improved hot fill container design that possesses optimal capacity to accommodate volumetric expansion and contraction, grippability and dimensional stability while being gripped.

SUMMARY OF THE INVENTION

Accordingly, it is an object of the invention to provide an improved hot fill container design that possesses optimal capacity to accommodate volumetric expansion and contraction, grippability and dimensional stability while being gripped.

In order to achieve the above and other objects of the invention, a plastic container according to a first aspect of the invention includes a bottom portion and a sidewall portion. The sidewall portion has a maximum outer diameter, and further includes a first pair of opposing first vacuum panels, the first vacuum panels each having a first substantially constant radius of curvature as measured in a horizontal plane, the first substantially constant radius of curvature being substantially constant from an upper end of each of the respective first vacuum panels to a lower end, and wherein a ratio of the first substantially constant radius of curvature to the maximum outer diameter is within a range of about 0.3 to about 2.5; and a second pair of opposing second vacuum panels, at least one of the second vacuum panels including gripping structure, the second vacuum panels each having a second substantially constant radius of curvature as measured in a horizontal plane, the second substantially constant radius of curvature being substantially constant, excluding the gripping structure, from an upper end of each of the respective second vacuum panels to a lower end, and wherein a ratio of the second substantially constant radius of curvature to the maximum outer diameter is within a range of about 0.2 to about 2.

According to a second aspect of the invention, a plastic container includes a bottom portion; and a sidewall portion, the sidewall portion having a maximum outer diameter, and wherein the sidewall portion further includes a first pair of opposing first vacuum panels; and a second pair of opposing second vacuum panels, at least one of the second vacuum panels including gripping structure and being shaped so as to be asymmetric about a central vertical axis when viewed in side elevation.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
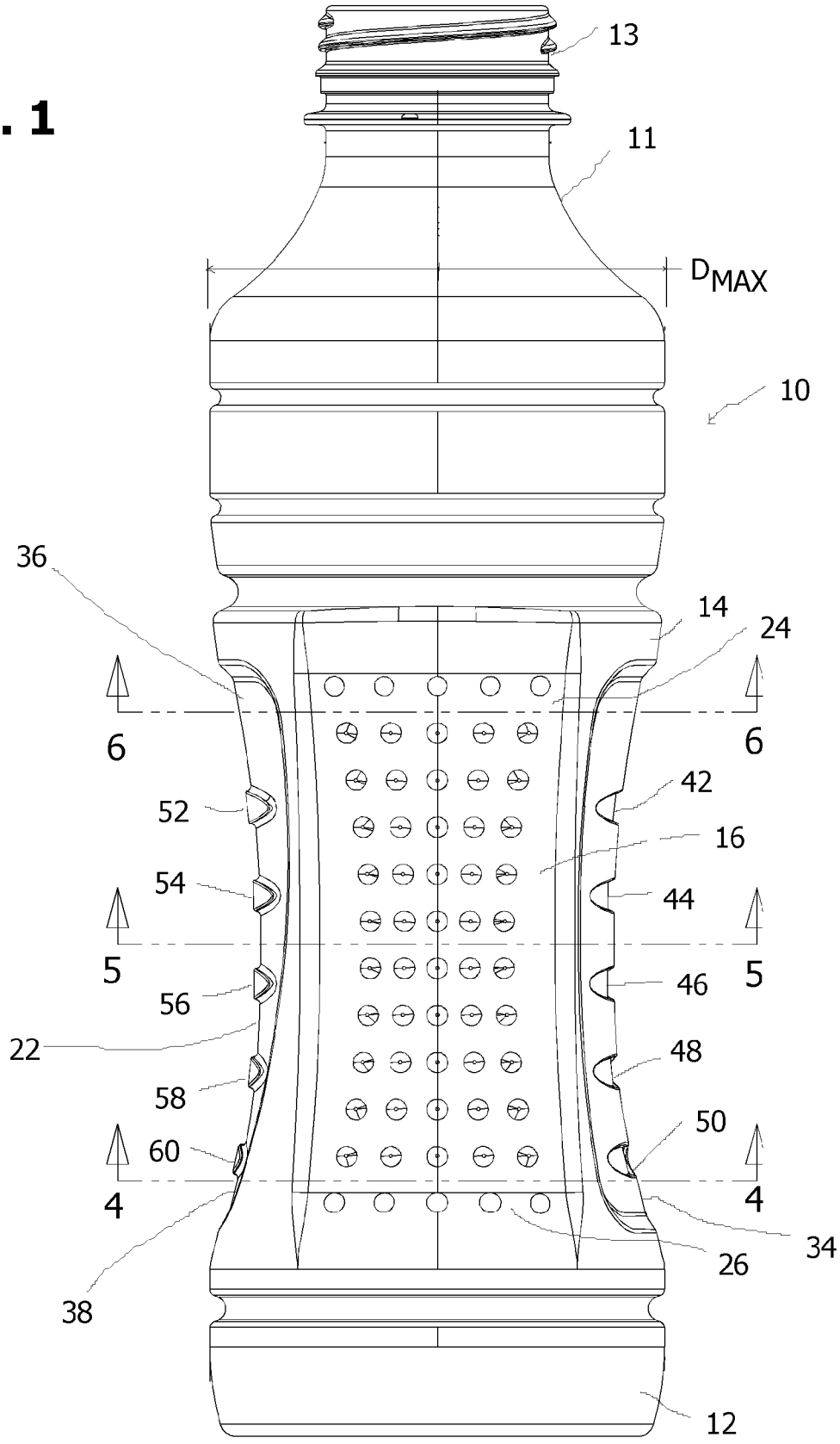
FIG. 1 is a front elevational view of a container that is constructed according to a preferred embodiment of the invention.

Referring now to the drawings, wherein like reference numerals designate corresponding structure throughout the views, and referring in particular to FIG. 1, a plastic container 10 that is constructed according to a preferred embodiment of the invention includes a bottom portion 12 and a sidewall portion 14. Container 10 also preferably includes a neck portion 11 and a threaded finish portion 13, as is typical in containers of this type. The sidewall portion 14 is preferably molded in a single unitary piece with the bottom portion 12 and the rest of the container 10 out of a plastic material such as PET, using an industry-standard process such as stretch blow molding.

Container 10 is adapted for use in hot-fill applications, but could potentially be used for other applications, and in particular those applications for which significant changes in internal container volume as a result of pressure and temperature differences are anticipated.

Sidewall portion 14 is preferably generally cylindrical and has a maximum outer diameter, $D_{MAX}$, as is shown in FIG. 1. At the location of the maximum outer diameter $D_{MAX}$, sidewall portion 14 is generally circular when viewed in horizontal cross-section. Sidewall portion 14 is preferably constructed so as to define a first pair of opposing first vacuum panels 16, 18.

The first vacuum panels 16, 18 each preferably are shaped so as to define a first substantially constant radius of curvature $R_1$, as measured in a horizontal plane, that is substantially constant from an upper end 24, 28 of each of the respective first vacuum panels 16, 18 to a lower end 26, 30 of the respective vacuum panels 16, 18.

Preferably, a ratio of the first substantially constant radius of curvature $R_1$ to the maximum outer diameter $D_{MAX}$ is within a range of about 0.3 to about 2.5. More preferably, the ratio of the first substantially constant radius of curvature $R_1$ to the maximum outer diameter $D_{MAX}$ is within a range of about 0.4 to about 1.5. Most preferably, the ratio of the first substantially constant radius of curvature $R_1$ to the maximum outer diameter $D_{MAX}$ is within a range of about 0.6 to about 0.9.

Sidewall portion 14 also preferably defines a second pair of opposing second vacuum gripping panels 20, 22. As will be discussed in greater detail below, at least one of the second, gripping vacuum panels 20, 22 preferably includes gripping structure for facilitating secure gripping of the container 10 by a consumer. In the preferred embodiment, vacuum panel 20 is provided with a plurality of generally horizontally oriented concave grooves 42, 44, 46, 48 and 50. Additionally, vacuum panel 22 is preferably provided with a plurality of generally horizontally oriented protruding ribs 52, 54, 56, 58 and 60 that are shaped and spaced so as to fit between the fingers of a typical consumer.

The second vacuum panels 20, 22 are each shaped in areas not including the ribs 52, 54, 56, 58 so as to define a second substantially constant radius of curvature $R_2$ as measured in a horizontal plane. The second substantially constant radius of curvature $R_2$ is substantially constant, excluding the above-described gripping structure, from an upper end 32, 36 of each of the respective second vacuum panels 20, 22 to a lower end 34, 38 of the vacuum panels 20, 22.

Preferably, a ratio of the second substantially constant radius of curvature $R_2$ to the maximum outer diameter $D_{MAX}$ is within a range of about 0.2 to about 2. More preferably, the ratio of the second substantially constant radius of curvature $R_2$ to the maximum outer diameter $D_{MAX}$ is within a range of about 0.3 to about 1.5. Most preferably, the ratio of the second substantially constant radius of curvature $R_2$ to the maximum outer diameter $D_{MAX}$ is within a range of about 0.5 to about 0.7.

In addition, the vacuum panels 16, 18, 20 and 22 are preferably shaped so that a ratio of the first substantially constant radius of curvature $R_1$ to the second substantially constant radius of curvature $R_2$ is within a range of about 0.15 to about 12.5. More preferably, the ratio of the first substantially constant radius of curvature $R_1$ to the second substantially constant radius of curvature $R_2$ is within a range of about 0.25 to about 5. Most preferably, the ratio of the first substantially constant radius of curvature $R_1$ to the second substantially constant radius of curvature $R_2$ is within a range of about 0.85 to about 1.8.

Figure 2:
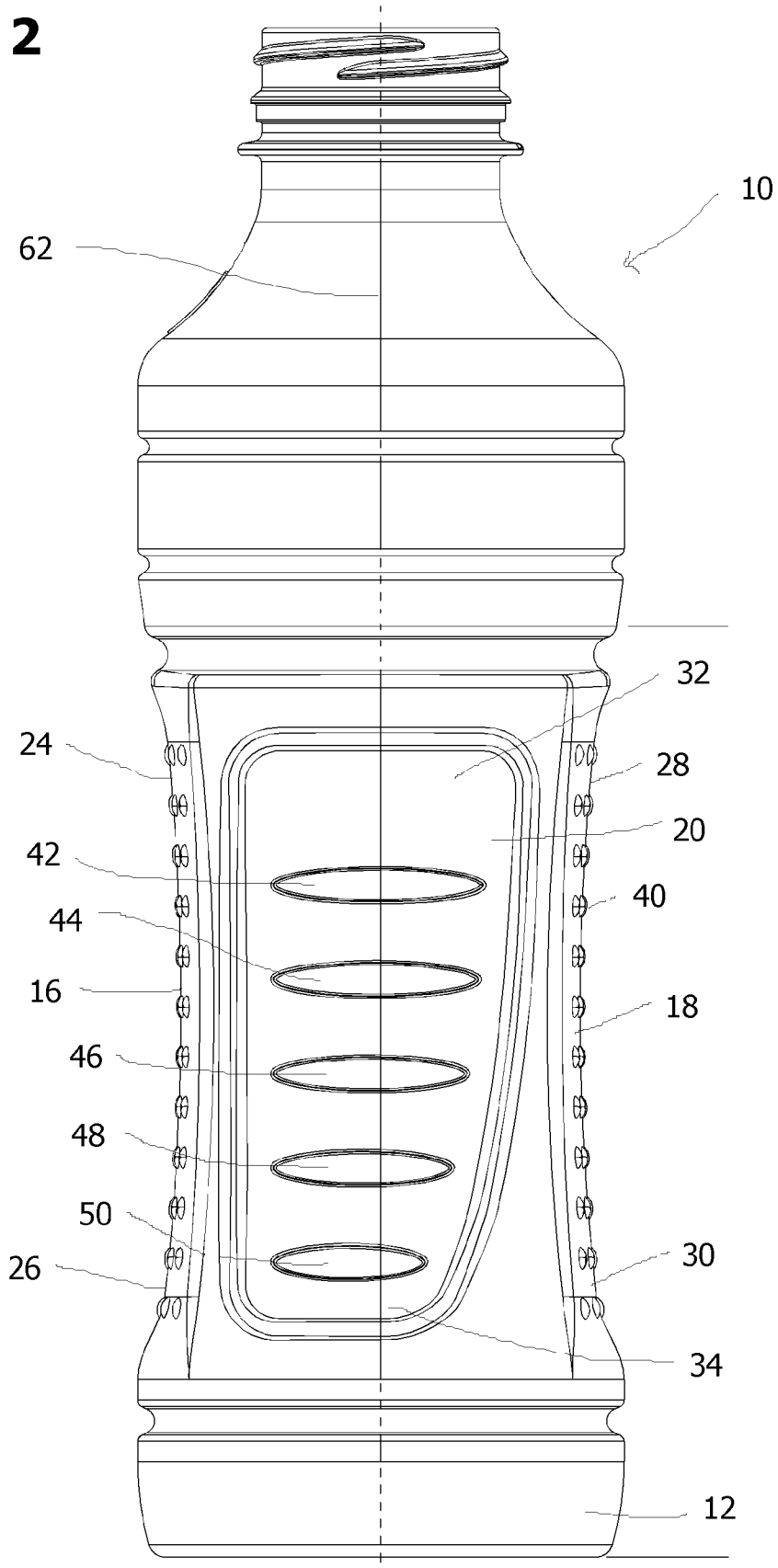
FIG. 2 is a first side elevational view.
Figure 3:
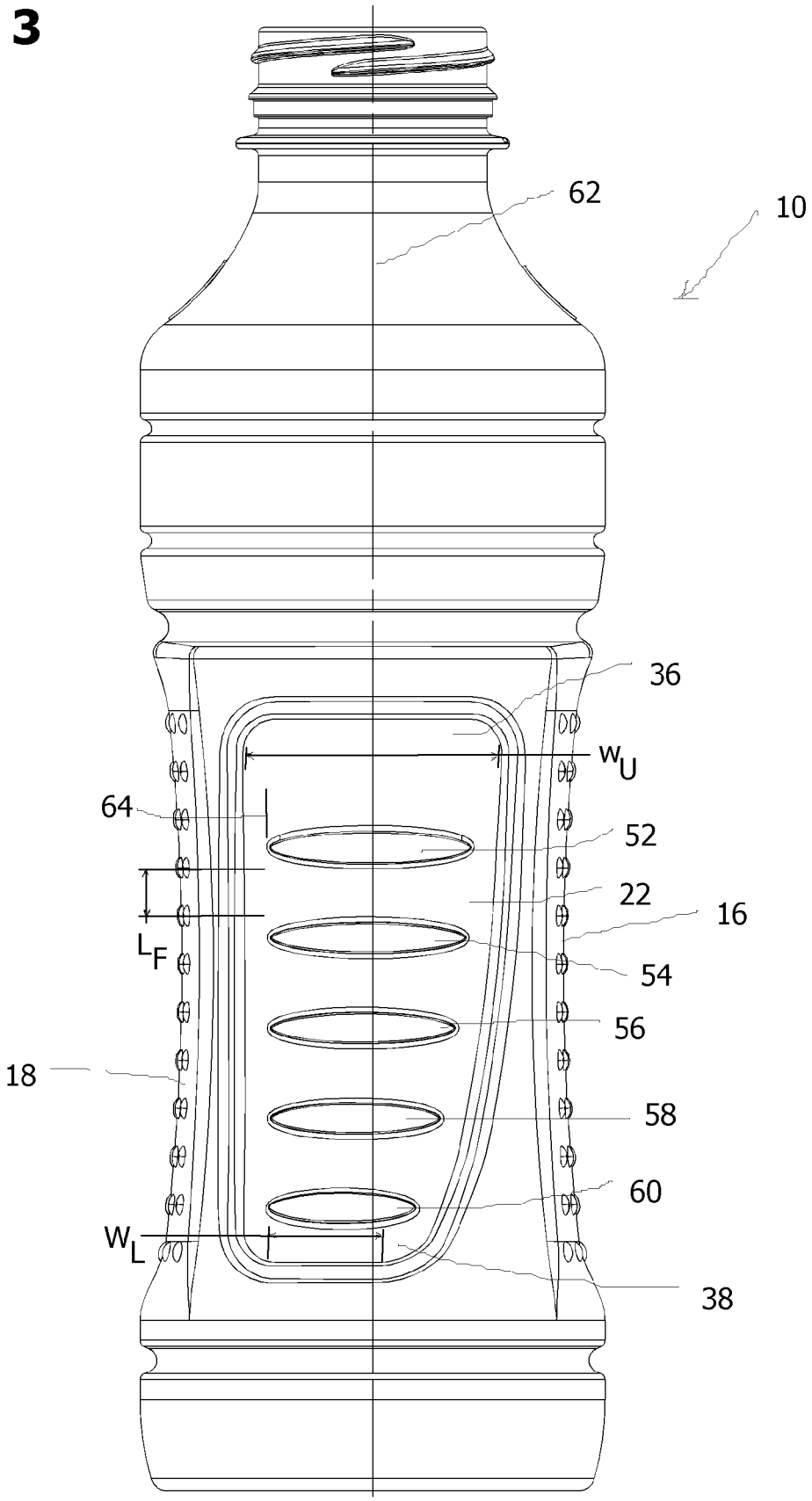
FIG. 3 is a second side elevational view.
Figure 4:
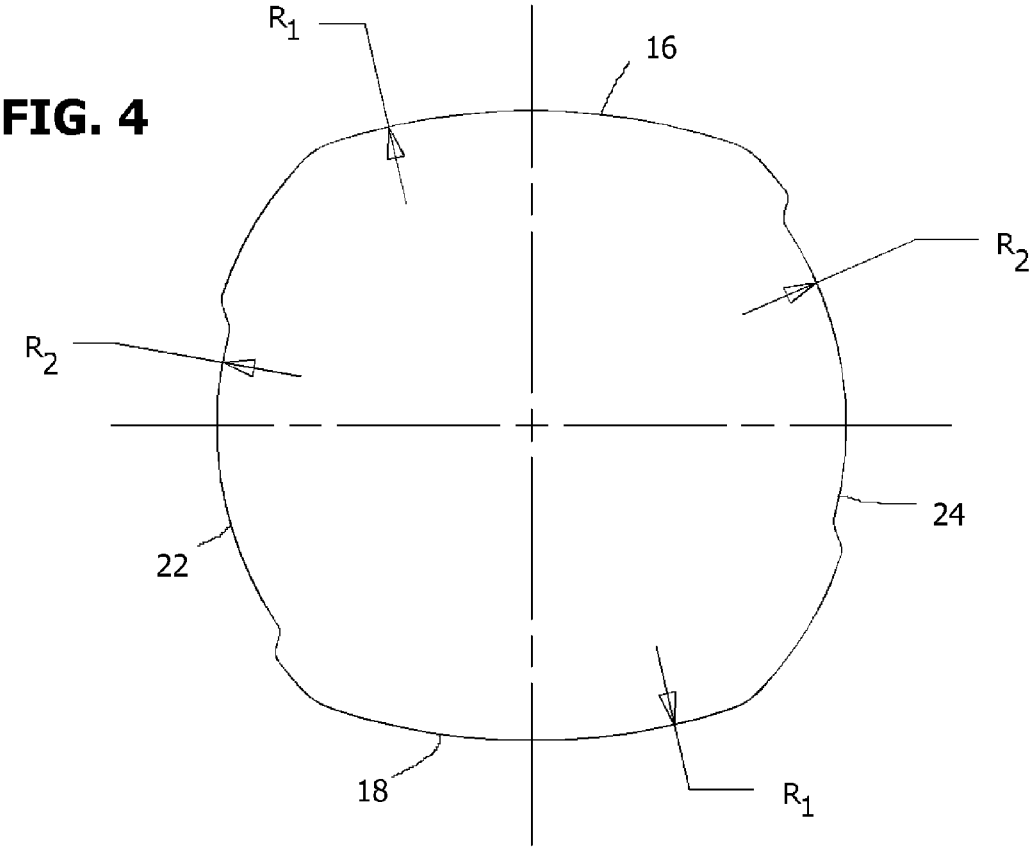
FIG. 4 is a cross-sectional view taken along lines 4-4 in FIG. 1.
Figure 5:
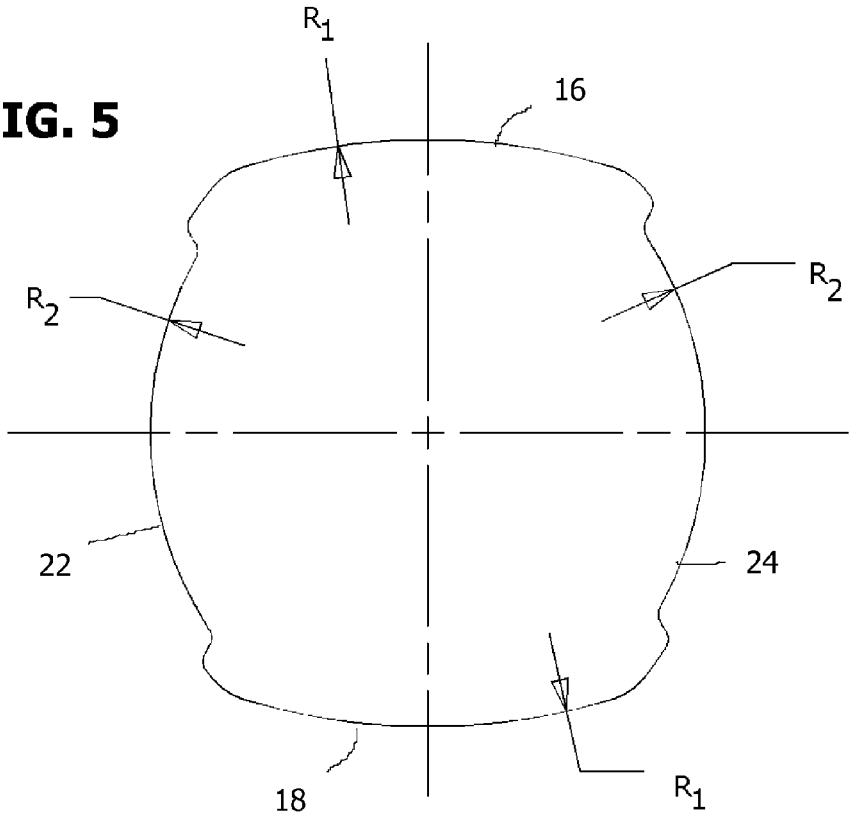
FIG. 5 is a cross-sectional view taken along lines 5-5 in FIG. 1.
Figure 6:
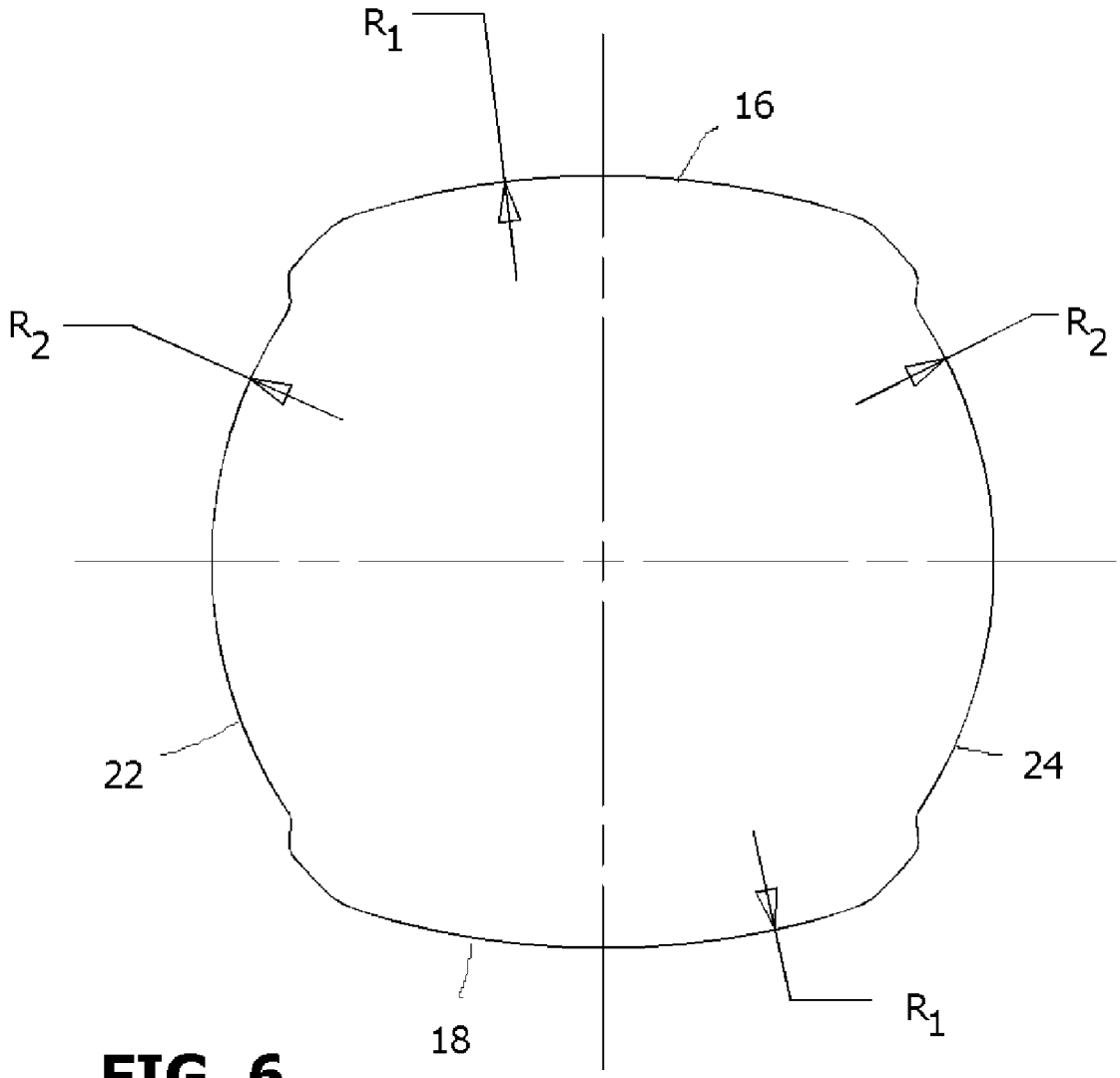
FIG. 6 is a cross-sectional view taken along lines 6-6 in FIG. 1.

According to another aspect of the invention, at least one of the second, gripping pair of vacuum panels 20, 22 may be shaped so as to be asymmetric about a central vertical axis 62 when viewed in side elevation, as is shown in FIGS. 2 and 3. As will be described below, such asymmetry may advantageously correspond to the inherent asymmetry of the human hand when it is used to grip such a container. In addition, at least one of the second pair of vacuum panels 20, 22 may be shaped so as to have a width $W_U$ as viewed in side elevation at its upper end 32, 36 that is different than the width $W_L$ of the respective vacuum panel 20, 22 at its lower end 34, 38. In the preferred embodiment, both of the vacuum panels 20, 22 are shaped so as to be asymmetric about their central vertical axis 62 when viewed in side elevation, and both are shaped so as to have a width $W_U$ as viewed in side elevation at their upper ends 32, 36 that is different than the width $W_L$ of the respective vacuum panel 20, 22 at its lower end 34, 38.

In the preferred embodiment, both of the vacuum panels 20, 22 are wider at their upper ends than at their lower ends. Referring to FIG. 3, which is a side elevational view showing vacuum panel 22, a ratio of the width $W_L$ of the vacuum panel 22 at its lower end to the its width $W_U$ at the upper end is within a range of about 0.35 to about 0.9. More preferably, the ratio of the width $W_L$ as viewed in side elevation at the lower end to the width $W_U$ at the upper end is within a range of about 0.45 to about 0.85. Most preferably, the ratio of the width $W_L$ as viewed in side elevation at the lower end to the width $W_U$ at the upper end is within a range of about 0.55 to about 0.75.

As was briefly described above, vacuum panel 20 is provided with a plurality of generally horizontally oriented concave grooves 42, 44, 46, 48 and 50. Additionally, vacuum panel 22 is preferably provided with a plurality of generally horizontally oriented protruding ribs 52, 54, 56, 58 and 60 that are shaped and spaced so as to fit between the fingers of a typical consumer. As FIG. 3 shows, respective first ends of the protruding ribs 52, 54, 56, 58 and 60 are preferably substantially aligned within a substantially vertical plane 64. However, all of the protruding ribs 52, 54, 56, 58 and 60 are not of equal width. In the illustrated embodiment, the width of the protruding ribs becomes progressively less from the upper end 36 of the vacuum panel 22 to the lower end 38 of the vacuum panel 22. This structure corresponds to the general reduction in finger length of the typical consumer from the forefinger to the little finger.

In addition, the protruding ribs 52, 54, 56, 58 and 60 are sized and spaced so that respective smooth spaces are defined therebetween for comfortably receiving the fingers of the typical consumer. A minimum vertical space $L_F$ is therefore defined between adjacent ribs, which is preferably at least 0.5 inch, but is more preferably at least 0.55 inch.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a bottom portion; and a sidewall portion, said sidewall portion having a maximum outer diameter, and wherein said sidewall portion further comprises:

a first pair of opposing first vacuum panels, said first vacuum panels each having a first substantially constant radius of curvature as measured in a horizontal plane, said first substantially constant radius of curvature being substantially constant from an upper end of each of said respective first vacuum panels to a lower end, and wherein a ratio of said first substantially constant radius of curvature to said maximum outer diameter is within a range of about 0.3 to about 2.5; and a second pair of opposing second vacuum panels, at least one of said second vacuum panels including gripping structure, said second vacuum panels each having a second substantially constant radius of curvature as measured in a horizontal plane, said second substantially constant radius of curvature being substantially constant, excluding said gripping structure, from an upper end of each of said respective second vacuum panels to a lower end, and wherein a ratio of said second substantially constant radius of curvature to said maximum outer diameter is within a range of about 0.2 to about 2.

2. A plastic container according to claim 1, wherein said ratio of said first substantially constant radius of curvature to said maximum outer diameter is within a range of about 0.4 to about 1.5.

3. A plastic container according to claim 2, wherein said ratio of said first substantially constant radius of curvature to said maximum outer diameter is within a range of about 0.6 to about 0.9.

4. A plastic container according to claim 1, wherein said ratio of said second substantially constant radius of curvature to said maximum outer diameter is within a range of about 0.3 to about 1.5.

5. A plastic container according to claim 4, wherein said ratio of said second substantially constant radius of curvature to said maximum outer diameter is within a range of about 0.5 to about 0.7.

6. A plastic container according to claim 1, wherein a ratio of said first substantially constant radius of curvature to said second substantially constant radius of curvature is within a range of about 0.15 to about 12.5.

7. A plastic container according to claim 6, wherein said ratio of said first substantially constant radius of curvature to said second substantially constant radius of curvature is within a range of about 0.25 to about 5.

8. A plastic container according to claim 7, wherein said ratio of said first substantially constant radius of curvature to said second substantially constant radius of curvature is within a range of about 0.85 to about 1.8.

9. A plastic container according to claim 1, wherein said gripping structure comprises at least one protruding rib defined in at least one of said second vacuum panels.

10. A plastic container according to claim 1, wherein at least one of said second vacuum panels is shaped so as to be asymmetric about a central vertical axis when viewed in side elevation.

11. A plastic container according to claim 10, wherein said at least one of said second vacuum panels is further shaped so as to have a width as viewed in side elevation at said upper end that is different than at said lower end.

12. A plastic container according to claim 11, wherein a ratio of said width as viewed in side elevation at said lower end to said width at said upper end is within a range of about 0.35 to about 0.9.

13. A plastic container according to claim 12, wherein said ratio of said width as viewed in side elevation at said lower end to said width at said upper end is within a range of about 0.45 to about 0.85.

14. A plastic container according to claim 13, wherein said ratio of said width as viewed in side elevation at said lower end to said width at said upper end is within a range of about 0.55 to about 0.75.

15. A plastic container according to claim 1, wherein said first substantially constant radius of curvature is greater than said second substantially constant radius of curvature.

16. A plastic container, comprising:

a bottom portion; and a sidewall portion, said sidewall portion having a maximum outer diameter, and wherein said sidewall portion further comprises:

a first pair of opposing first vacuum panels;

a second pair of opposing second vacuum panels, at least one of said second vacuum panels including gripping structure and being shaped so as to be asymmetric about a central vertical axis when viewed in side elevation; and wherein said at least one of said second vacuum panels is further shaped so as to have a width as viewed in side elevation at said upper end that is different than at said lower end.

17. A plastic container according to claim 16, wherein a ratio of said width as viewed in side elevation at said lower end to said width at said upper end is within a range of about 0.35 to about 0.9.

18. A plastic container according to claim 17, wherein said ratio of said width as viewed in side elevation at said lower end to said width at said upper end is within a range of about 0.45 to about 0.85.

19. A plastic container according to claim 18, wherein said ratio of said width as viewed in side elevation at said lower end to said width at said upper end is within a range of about 0.55 to about 0.75.

20. A plastic container according to claim 16, wherein said gripping structure comprises at least one protruding rib defined in at least one of said second vacuum panels.

21. A plastic container according to claim 20, wherein said gripping structure comprises a plurality of said protruding ribs, and wherein said protruding ribs are oriented substantially horizontally as viewed in side elevation.

22. A plastic container according to claim 21, wherein respective first ends of said protruding ribs are substantially aligned within a substantially vertical plane.

23. A plastic container according to claim 22, wherein said protruding ribs are not all of equal width.

24. A plastic container according to claim 21, wherein said protruding ribs are not all of equal width.

* * * * *